US010780594B1

(12) United States Patent
Chen

(10) Patent No.: US 10,780,594 B1
(45) Date of Patent: Sep. 22, 2020

(54) STAGGERED MULTILAYER TRIMMING HEAD APPLIED IN AN ELECTRIC HAIRCUTTER

(71) Applicant: TZENG FONG INDUSTRIAL CORPORATION, New Taipei (TW)

(72) Inventor: Chin-Chuan Chen, New Taipei (TW)

(73) Assignee: TZENG FONG INDUSTRIAL CORPORATION, New Taipei (TW)

( * ) Notice: Subject to any disclaimer, the term of this patent is extended or adjusted under 35 U.S.C. 154(b) by 0 days.

(21) Appl. No.: 16/438,499

(22) Filed: Jun. 12, 2019

(51) Int. Cl.

| | |
|---|---|
| ***B26B 19/06*** | (2006.01) |
| ***B26B 19/20*** | (2006.01) |
| ***B26B 19/04*** | (2006.01) |
| ***B26B 19/38*** | (2006.01) |

(52) U.S. Cl.
CPC ..... *B26B 19/046* (2013.01); *B26B 19/06* (2013.01); *B26B 19/205* (2013.01); *B26B 19/3873* (2013.01)

(58) Field of Classification Search
CPC ..... B26B 19/046; B26B 19/205; B26B 19/06
USPC ..... 30/200, 223, 201
See application file for complete search history.

(56) References Cited

U.S. PATENT DOCUMENTS

| | | | | |
|---|---|---|---|---|
| 4,782,592 | A * | 11/1988 | Altamore | B26B 19/06 30/195 |
| 5,933,964 | A * | 8/1999 | Altamore | B26B 19/06 30/195 |
| 6,073,350 | A * | 6/2000 | Elston | B26B 19/06 30/216 |
| 7,841,091 | B2 * | 11/2010 | Melton | B26B 19/3846 30/223 |
| 8,769,828 | B2 * | 7/2014 | Lau | B26B 19/06 30/208 |
| 10,307,919 | B2 * | 6/2019 | Lau | B26B 19/06 |

* cited by examiner

*Primary Examiner* — Hwei-Siu C Payer
(74) *Attorney, Agent, or Firm* — Fei-hung Yang

(57) ABSTRACT

A staggered multilayer trimming head installed at a front end of an electric haircutter includes a bottom plate, a fixed blade, a moving knife module and a moving swing block. The moving knife module has a first moving knife and at least one second moving knife; an adjusting lever is coupled to the second moving knife for adjusting the position of the second moving knife with respect to the first moving knife quickly, and the moving knife module is coupled to a motor of the electric haircutter with power connection through the moving swing block. In a cutting/shearing operation, the adjustable moving blade allows the cutting and shearing to be adjusted to a single cutting and shearing track or a multiple of tracks, so as to complete various haircutting effects quickly without changing the operator's original operating habit and improve the haircutting efficiency and quality significantly.

9 Claims, 6 Drawing Sheets

STAGGERED MULTILAYER TRIMMING HEAD APPLIED IN AN ELECTRIC HAIRCUTTER

BACKGROUND

Technical Field

The present disclosure generally relates to the field of haircutting devices. More particularly, the present disclosure relates to a staggered multilayer trimming head applied in an electric haircutter, and the staggered multilayer trimming head has an adjustable moving blade design and can adjust a single or multiple cutting tracks and complete different haircutting effects quickly without changing the operator's original operating habit.

Description of Related Art

In general, hairstylists use special hairdressing tools such as scissors and electric haircutter to cut and trim hair for their customers, and various types of hairdressing tools are used for the hair cutting and trimming according to the requirements of the hairstylists and customers.

However, the scissors for hairdressing usually comes with a sharp blade design to provide the effect of trimming and cutting hair effectively. Therefore, special attention should be paid for the use and storage of these hairdressing scissors. The electric haircutter adopts an electric motor operated together with the alternate operation of the blades to cut and shear hair quickly, and this tool is primarily used for cutting a lot of hair. For example, the cutting speed of a crew cut is fast and usually cannot be controlled precisely for processing the hair in details, so that most hairstylists generally use both scissors and electric haircutter simultaneously when doing haircuts. However, when the aforementioned two hairdressing tools are used, the hairstylists combs a person's hair to be cut and sheared by holding or using a comb, and then carries out the cutting and shearing operation, and the blades of the scissors and the electric haircutter cut hair from a lateral direction by a unidirectional outward pressing and cutting method. This conventional method not just forms a slant and uneven surface only, but also takes much time for using the special scissors for a layer cut.

For example, the electric haircutter comprises a main body, a motor and a power source installed in the main body, a trimming head installed to a front end of the main body. After the trimming head is coupled to the motor with power connection, a cutting and shearing track can be formed, so that the operation is carried out by forming the cutting and shearing track by the trimming head in order to cut and shear hair. Since the shear speed of the electric haircutters is very fast, the electric haircutters are mostly applied for push cutting (or a large-area hair cutting and shearing). During operation, the trimming head is usually operated with a baffle that controls the length of hair, and a side of the trimming head abuts a scalp, and a spacing distance is formed between the baffle and the trimming head, and the trimming length can be adjusted quickly. Therefore, such electric haircutter can be used for large-area haircutting, and a special layer cut still requires a manual operation of the scissors and uses the serrated structures of the blades on both sides to produce a different layered effect, so that and the cut can be carried out quickly and the length of the layer cut can be controlled precisely. Obviously, the conventional method still requires improvements.

Therefore, the inventor of the present disclosure based on years of experience in the related hairdressing tool industry to conduct extensive research and experiment, and finally developed a staggered multilayer trimming head applied in an electric haircutter, whose adjustable moving blade design allows a single cutting and shearing track or a plurality of cutting tracks in a cutting and shearing process, so as to achieve various haircutting effects quickly without changing original operating habits.

SUMMARY

In view of the aforementioned drawbacks of the prior art, the inventor of the present disclosure discloses a staggered multilayer trimming head applied in an electric haircutter, wherein a moving knife module has a first moving knife and at least one second moving knife, and an adjusting lever is coupled to the second moving knife to provide an adjustable moving blade design to allows a single cutting and shearing track or a plurality of cutting tracks in a cutting and shearing process, so as to achieve various haircutting effects quickly without changing original operating habits and improve the haircutting efficiency and quality.

To achieve the aforementioned and other objectives, the present disclosure provides a staggered multilayer trimming head applied in an electric haircutter, wherein the electric haircutter has a main body, a motor and a power source installed in the main body, and an electric block coupled to a front end of a rotating shaft of the motor for producing an eccentric rotary motion, and the staggered multilayer trimming head comprises: a bottom plate, installed and fixed to a front end of the main body, and having at least one window formed on a surface of the bottom plate; a fixed blade, fixed onto the bottom plate, and having a first serrated structure equidistantly disposed at a front edge of the fixed blade; a moving knife module, movably installed on a side of the fixed blade, and comprising a first moving knife, at least one second moving knife, at least one adjusting lever, a spring pressing plate and a pressing plate, and the front end of the first moving knife having a second serrated structure configured to be corresponsive to the first serrated structure, and at least one first notch with a quantity corresponding to the quantity of the second moving knives, and the second moving knife having a third serrated structure disposed at a front edge thereof and configured to be corresponsive to the first serrated structure and movably received in the first notch, so that after the second serrated structure and the third serrated structure are combined, the second serrated structure and the third serrated structure are staggered with the first serrated structure, and one or more cutting and shearing track can be formed in a cutting and shearing process, and a rear end of the second moving knife being coupled to the adjusting lever, so that a rear end of the adjusting lever is received in one of the windows which is exposed from the bottom plate, and the spring pressing plate and the pressing plate being provided for pressing and positioning the first moving knife and the second moving knife to a position of the fixed blade; and a moving swing block, fixed to a side of the moving knife module, and coupled to the first moving knife, and the other side of the moving swing block being coupled to the eccentric block; thereby, during operation, the power connection formed between the motor and the moving swing block drives the first moving knife and the second moving knife to move reciprocally and transversally sideway, and the first moving knife and the second moving knife are used for moving alternately, reciprocally, and transversally with respect to the fixed blade to carry out a trimming operation, and the position of the second moving knife is adjusted with respect to the first moving knife to produce a layering sense of hair with unequal lengths.

In an embodiment, the bottom plate has a plurality of fixing parts disposed on a side thereof and configured to be corresponsive to the fixed blade and the moving knife module and provided for installing and positioning the fixed blade and the moving knife module.

In another embodiment, the first moving blade has a plurality of first notches separately disposed at a front edge of the first moving blade for receiving the plurality of second moving knives respectively, and each second moving knife is coupled to each respective adjusting lever for adjusting the position of each second moving knife with respect to the first moving blade. In addition, the second moving knife has a hook formed at a rear end of the second moving knife, and a first fixed portion disposed at a front end of the adjusting lever and configured to be corresponsive to the hook, and a connection is defined by clamping the first fixed portion to the hook. The staggered multilayer trimming head applied in an electric haircutter according to the present disclosure further comprises a lever switch coupled to a rear end of the adjusting lever and disposed in one of the windows to facilitate adjusting the position of the second moving knife, and the lever switch has a bump, and a second fixed portion disposed at a rear end of the adjusting lever, and a connection is defined by clamping and fixing the second fixed portion to the bump.

In summation of the description above, the present disclosure has an adjustable moving blade design and uses the adjusting lever to adjust the position of each second moving knife with respect to the first moving knife quickly and can adjust a single or multiple cutting tracks and complete different haircutting effects quickly without changing the operator's original operating habit to achieve the effect of improving the haircutting efficiency and quality significantly.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DESCRIPTION OF THE EMBODIMENTS

Figure 1:
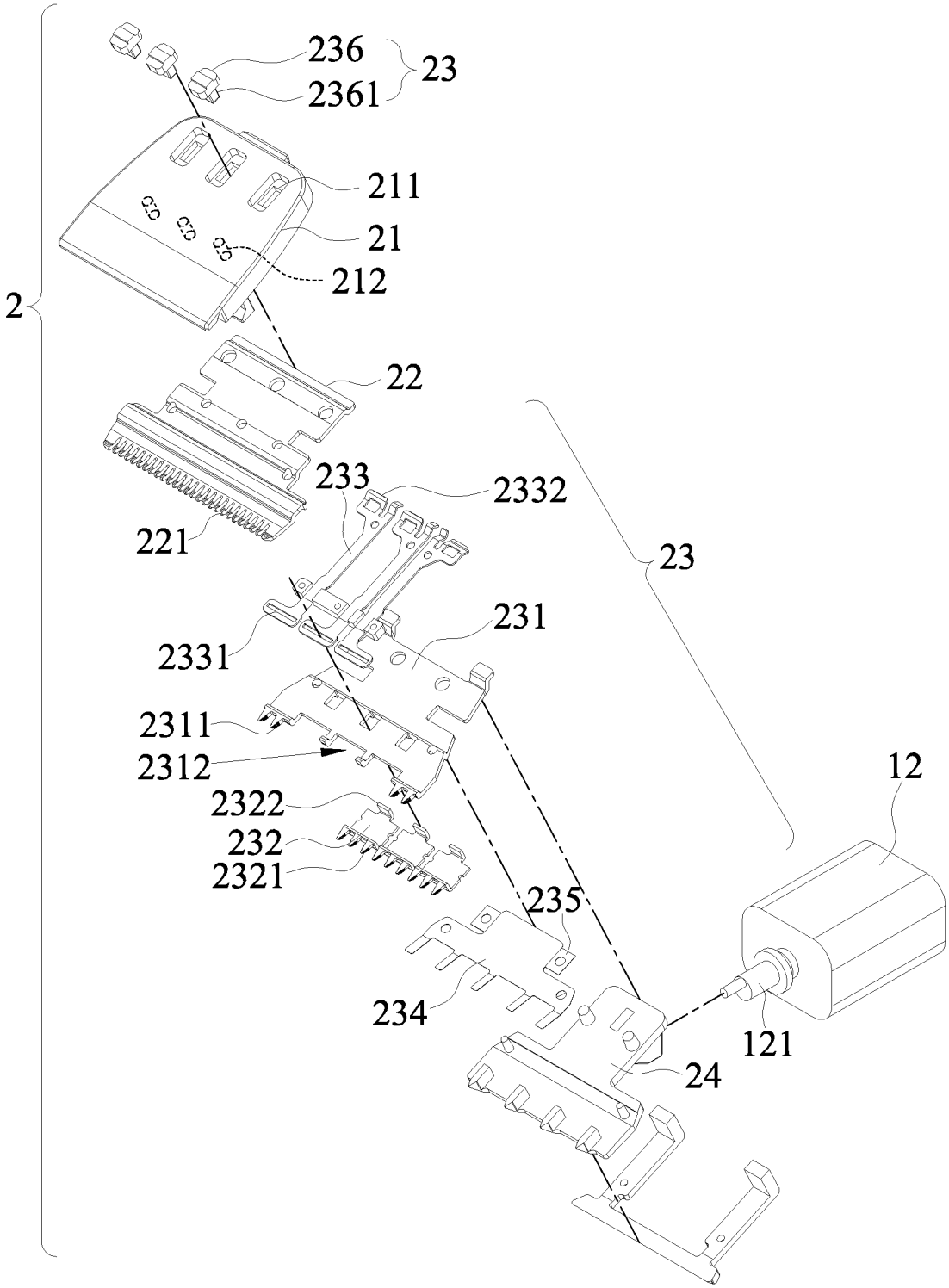
FIG. 1 is an exploded view of a preferred embodiment of this disclosure.

Reference will now be made in detail to the present embodiments of the disclosure, examples of which are illustrated in the accompanying drawings. Wherever possible, the same reference numbers are used in the drawings and the description to refer to the same or like parts.

Figure 2:
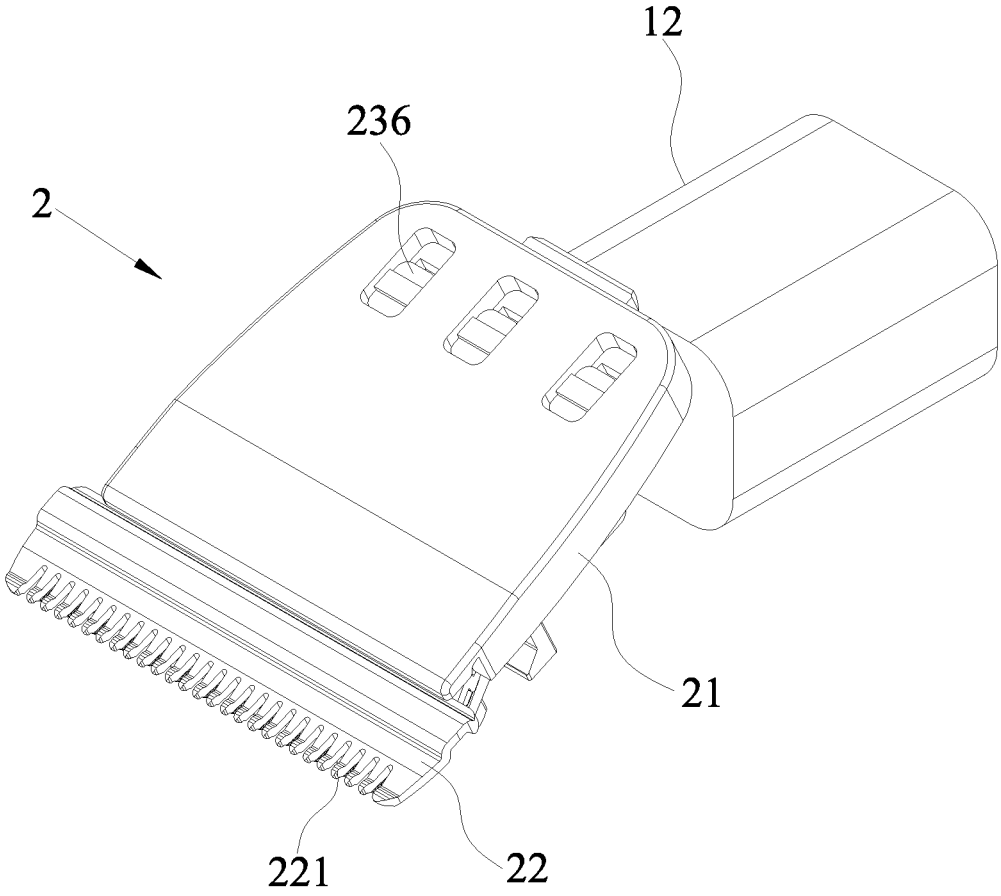
FIG. 2 is a cross-sectional view of a preferred embodiment of this disclosure.
Figure 3:
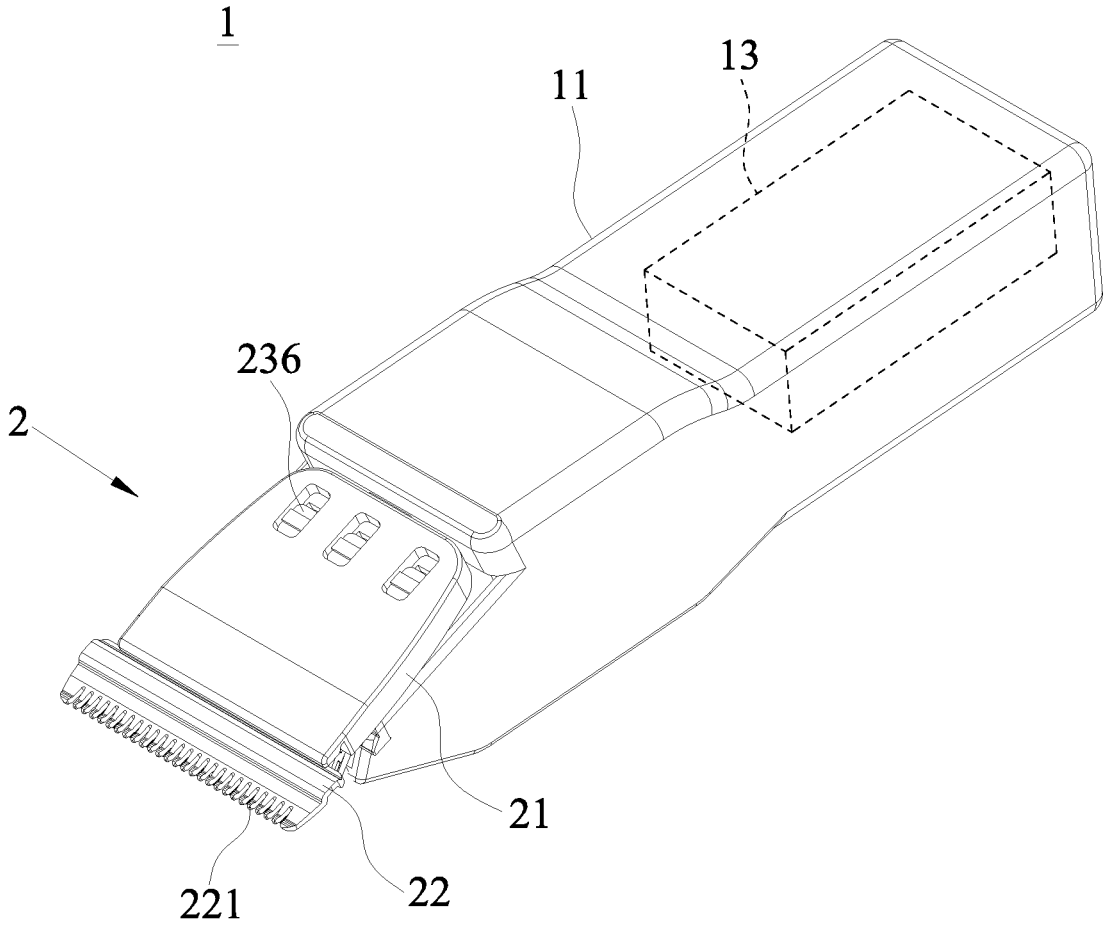
FIG. 3 is a schematic view of a preferred embodiment of this disclosure in the status when it is installed to a main body.

With reference to FIGS. 1, 2 and 3 for the exploded view and cross-sectional view and the schematic view of a preferred embodiment of the present disclosure being installed to a main body, a staggered multilayer trimming head 2 is applied to an electric haircutter 1, wherein the electric haircutter 1 has a main body 11, a motor 12 and a power source 13 installed in the main body 11, an eccentric block 121 coupled to a front end of a rotating shaft of the motor 12 for producing an eccentric rotary motion, and the staggered multilayer trimming head 2 comprises a bottom plate 21, a fixed blade 22, a moving knife module 23, and a moving swing block 24.

Wherein, the bottom plate 21 is installed and fixed to a front end of the main body 11, and three windows 211 are formed on a surface of bottom plate 21 and arranged with a space from each other. It is noteworthy that a side of the bottom plate 21 has a plurality of fixing parts 212 corresponding to the fixed blade 22 and the moving knife module 23 for installing and positioning the fixed blade 22 and the moving knife module 23.

The fixed blade 22 is fixed onto the bottom plate 21 through the plurality of fixing parts 212, and a first serrated structure 221 is equidistantly disposed at a front edge of the fixed blade 22.

The moving knife module 23 is movably installed on a side of the fixed blade 22, and the moving knife module 23 comprises a first moving knife 231, three second moving knives 232, three adjusting levers 233, a spring pressing plate 234 and a pressing plate 235, and the first moving knife 231 has a second serrated structure 2311 disposed at a front edge thereof and configured to be corresponsive to the first serrated structure 221, and three first notches 2312 comes with a quantity corresponding to the quantity of the second moving knives 232, and each second moving knife 232 has a third serrated structure 2321 disposed at a front edge thereof and configured to be corresponsive to the first serrated structure 221, and each second moving knife 232 is movably received in each first notch 2312, so that after the second serrated structure 2311 and the third serrated structure 2321 are combined, they are staggered with respect to the first serrated structure 221, and the rear end of each second moving knife 232 is coupled to each adjusting lever 233, so that the rear end of each adjusting lever 233 is disposed in each respective window 211 which is exposed from the bottom plate 21, and the spring pressing plate 234 and the pressing plate 235 are provided for pressing and positioning the first moving knife 231 and each second moving knife 232 on a position of the fixed blade 22. It is noteworthy that a hook 2322 is formed at a rear end of each second moving knife 232, and a first fixed portion 2331 is disposed at a front end of each adjusting lever 233 and configured to be corresponsive to the hook 2322, and the first fixed portion 2331 is clamped to the hook 2322 to define a connection. In addition, the rear end of each adjusting lever 233 has a second fixed portion 2332, and the staggered multilayer trimming head further has three lever switches 236, and each lever switch 236 has a bump 2361, and the second fixed portion 2332 is capable of clamping and fixing to the bump 2361, so that each lever switch 236 and each respective adjusting lever 233 are coupled to each other, and each lever switch 236 is disposed in each respective window 211 to facilitate adjusting the position of each second moving knife 232.

The moving swing block 24 is fixed to a side of the moving knife module 23, and the moving swing block 24 is coupled to the first moving knife 231, and the other side of the moving swing block 24 is coupled to the eccentric block 121.

During operation, the motor 12 produces a power connection through the eccentric block 121 and the moving swing block 24 to drive the first moving knife 231 and the second moving knives 232 reciprocally and transversally sideway, so that the first moving knife 231 and the second moving knife 232 can be moved reciprocally and transversally with respect to the fixed blade 22 to carry out a trimming operation. When the position of each second moving knife 232 with respect to the first moving knife 231 is adjusted, the cutting and shearing tracks of different quantities can be produced quickly to form the required sense of layering.

Figure 4:
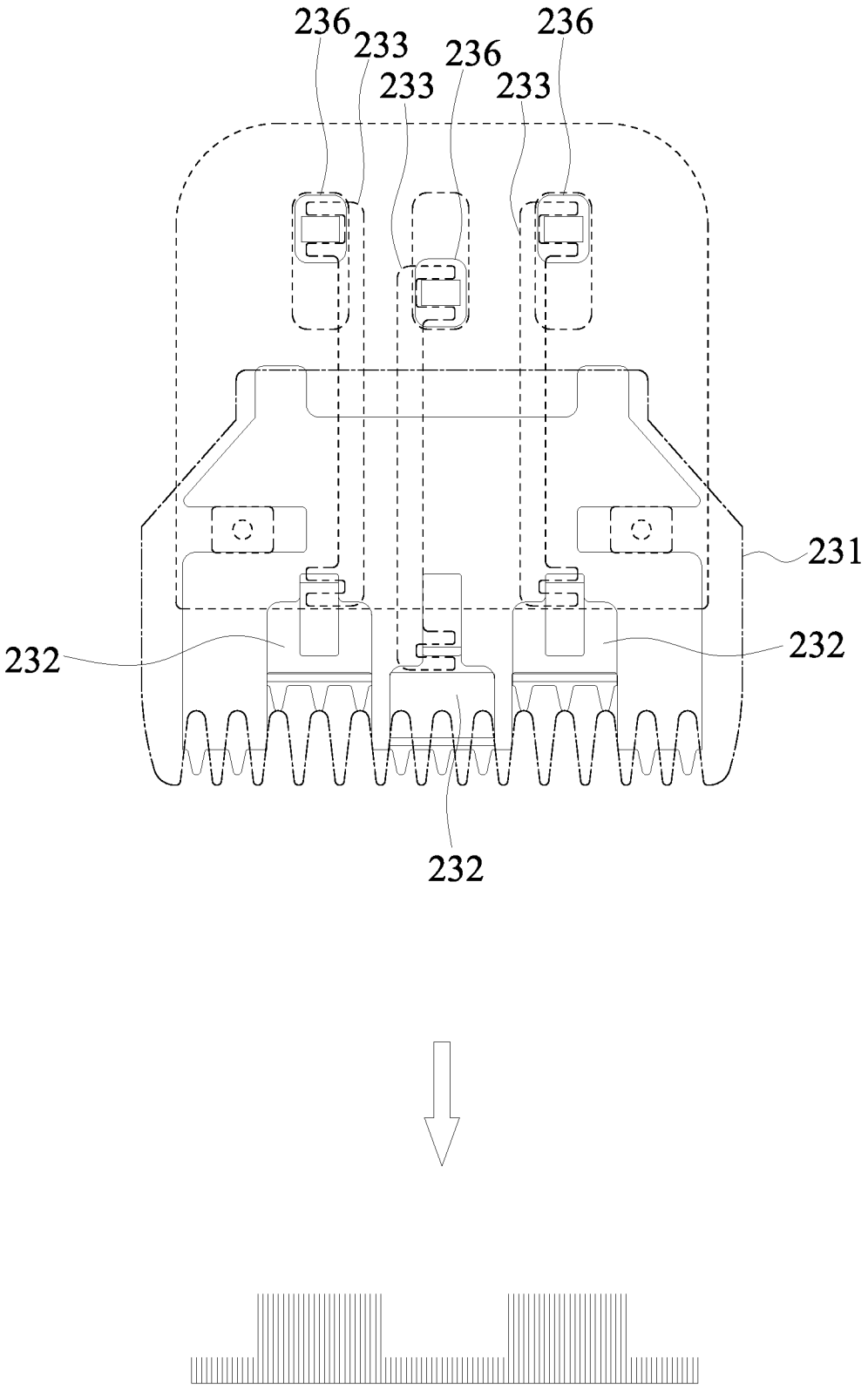
FIG. 4 is a schematic view showing a first adjusting status and a cutting in accordance with a preferred embodiment of this disclosure.
Figure 5:
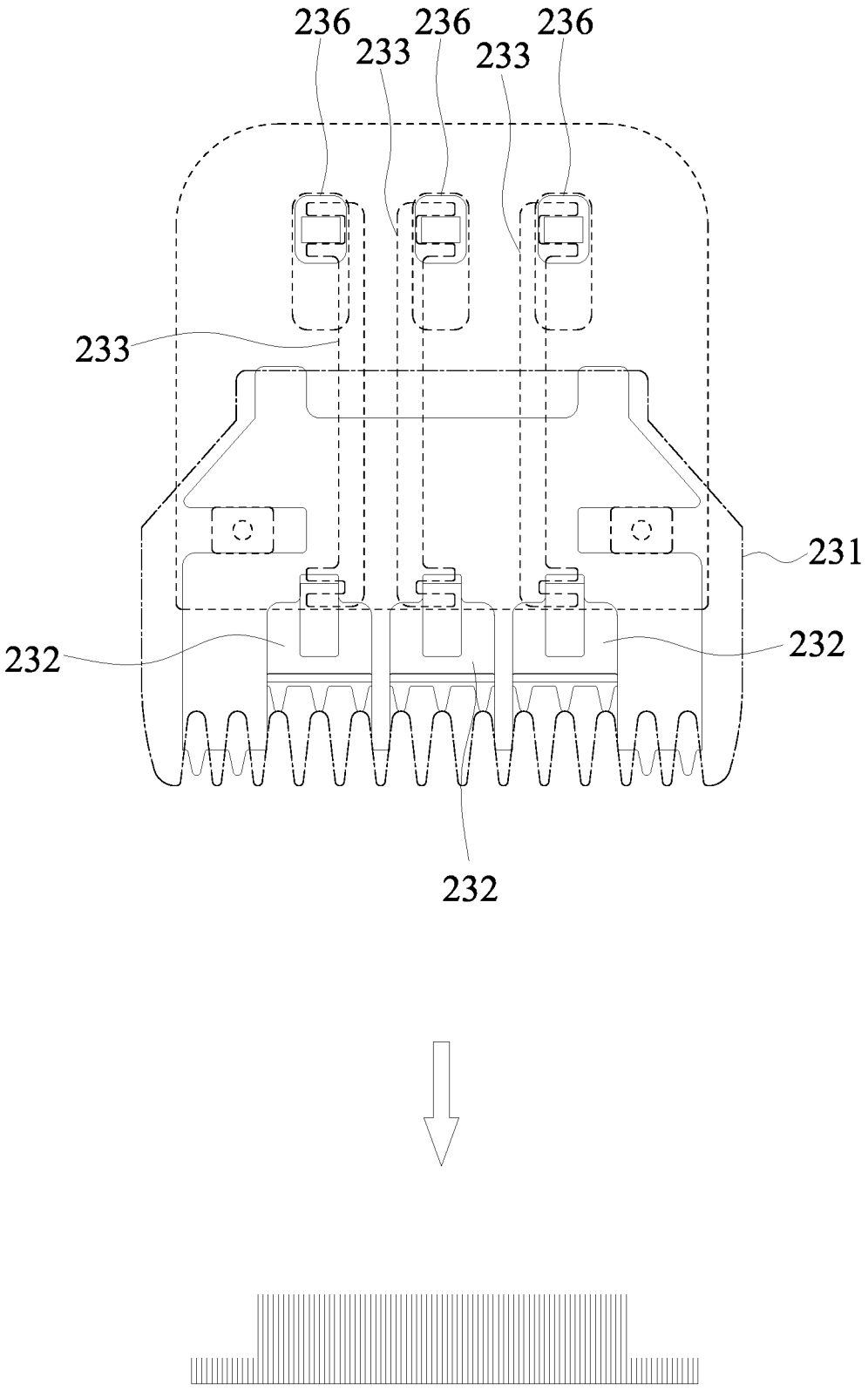
FIG. 5 is a schematic view showing a second adjusting status and a cutting in accordance with a preferred embodiment of this disclosure.
Figure 6:
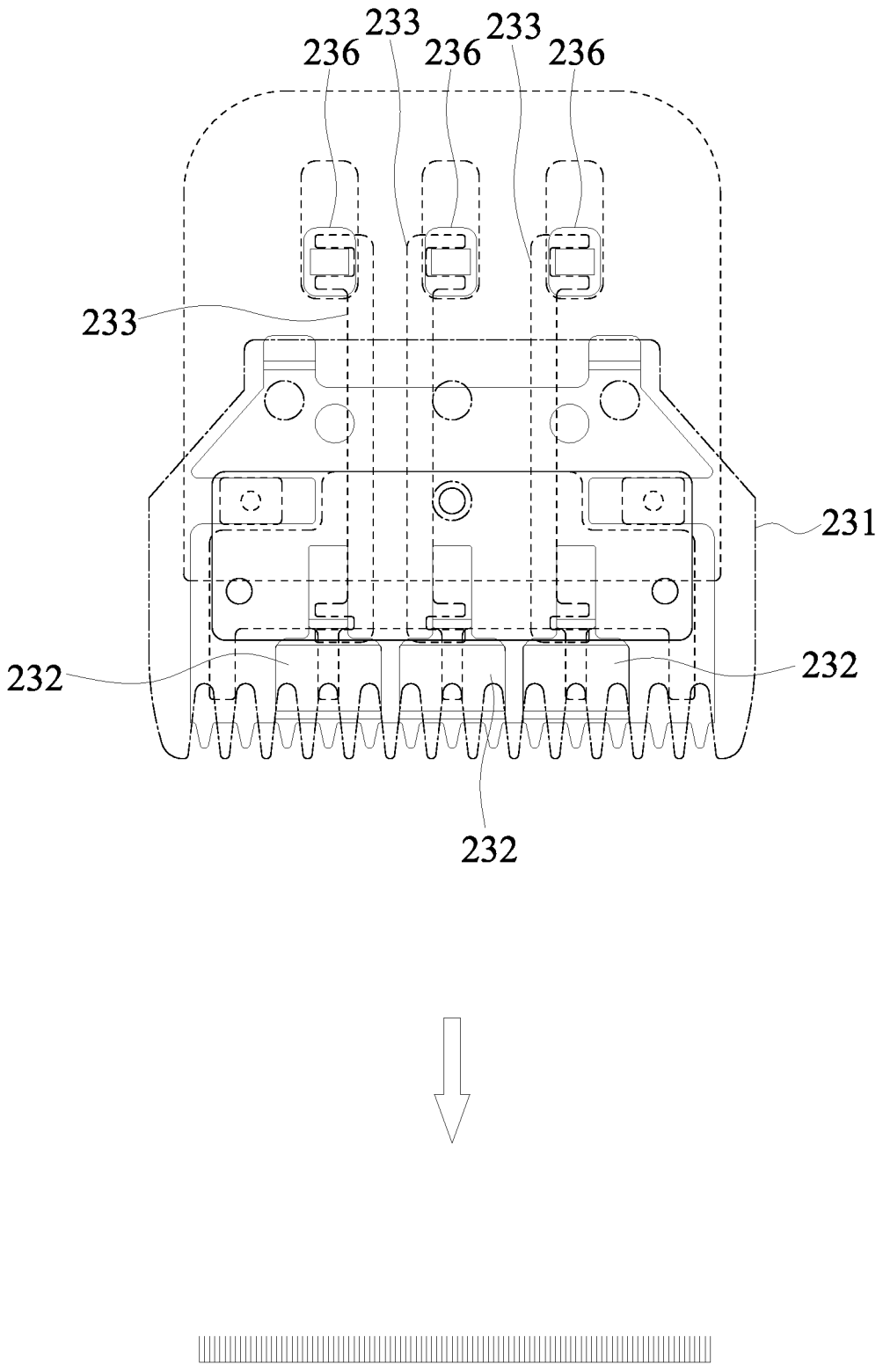
FIG. 6 is a schematic view showing a third adjusting status and a cutting in accordance with a preferred embodiment of this disclosure.

With reference to FIGS. 4 to 6 for the schematic view of various adjusting statuses and the schematic view of cutting and shearing in accordance with a preferred embodiment of the present disclosure respectively, the position of the staggered multilayer trimming head 2 and unequal quantities of the lever switches 236 of the present disclosure can be adjusted to link with the one or more adjusting levers 233 (of the same quantity) to change the position of the second moving knife 232 with respect to the first moving knife 231 as shown in FIG. 4 and move the lever switches 236 on both sides upward, and just the lever switch 236 at the middle remains at its original position, so that the two second moving knives 232 on both sides are retracted inwardly to form two cutting and shearing track with the corresponding width of the second moving knife 232 after the cutting and shearing process. In FIG. 5, the three lever switches 236 are operated to move upward, so that the three second moving knives 232 are retracted simultaneously, and a cutting and shearing track corresponding to the total width of the three second moving knives 232 is formed after the cutting and shearing process. In FIG. 6, the three lever switches 236 are remained in their original positions respectively, so that the three second moving knives 232 is completely coupled to a front edge of the first moving knife 231 for a normal cutting and shearing operation that only uses one cutting and shearing track.

What is claimed is:

1. A staggered multilayer trimming head applied in an electric haircutter, and the electric haircutter having a main body, a motor and a power source installed in the main body, and an eccentric block coupled to a front end of a rotating shaft of the motor for producing an eccentric rotary motion, and the staggered multilayer trimming head comprising:

a bottom plate, installed and fixed to a front end of the main body, and having at least one window formed on a surface of the bottom plate;

a fixed blade, fixed onto the bottom plate, and having a first serrated structure equidistantly disposed at a front edge of the fixed blade;

a moving knife module, movably installed on a side of the fixed blade, and comprising a first moving knife, at least one second moving knife, at least one adjusting lever, a spring pressing plate and a pressing plate, and a front end of the first moving knife having a second serrated structure configured to be corresponsive to the first serrated structure, and at least one first notch with a quantity corresponding to the quantity of the second moving knife, and the second moving knife having a third serrated structure disposed at a front edge thereof and configured to be corresponsive to the first serrated structure and movably received in the first notch, so that after the second serrated structure and the third serrated structure are combined, the second serrated structure and the third serrated structure are staggered with the first serrated structure, and a rear end of the second moving knife being coupled to the adjusting lever, so that a rear end of the adjusting lever is received in one of the at least one window which is exposed from the bottom plate, and the spring pressing plate and the pressing plate being provided for pressing and positioning the first moving knife and the second moving knife to a position of the fixed blade; and a moving swing block, having one side fixed to a side of the moving knife module, and coupled to the first moving knife, and the other side of the moving swing block being coupled to the eccentric block;

thereby, during operation, a power connection formed between the motor and the moving swing block drives the first moving knife and the second moving knife to move reciprocally and transversally sideway, and the first moving knife and the second moving knife are used for moving alternately, reciprocally, and transversally with respect to the fixed blade to carry out a trimming operation, and the position of the second moving knife is adjusted with respect to the first moving knife to produce a layering sense of hair with unequal lengths.

2. The staggered multilayer trimming head applied in an electric haircutter as claimed in claim 1, wherein the bottom plate has a plurality of fixing parts disposed on a side corresponding to the fixed blade and the moving knife module and provided for positioning and installing the fixed blade and the moving knife module.

3. The staggered multilayer trimming head applied in an electric haircutter as claimed in claim 2, wherein the first notch is separately disposed at a front edge of the first moving knife for receiving the second moving knife respectively, and each second moving knife is coupled to each respective adjusting lever for adjusting the position of each second moving knife with respect to the first moving knife.

4. The staggered multilayer trimming head applied in an electric haircutter as claimed in claim 1, wherein the second moving knife has a hook formed at a rear end of the second moving knife, and a first fixed portion disposed at a front end of the adjusting lever and configured to be corresponsive to the hook, and a connection is defined by clamping the first fixed portion to the hook.

5. The staggered multilayer trimming head applied in an electric haircutter as claimed in claim 4, further comprising a lever switch coupled to the rear end of the adjusting lever and disposed in one of the at least one window to facilitate adjusting the position of the second moving knife.

6. The staggered multilayer trimming head applied in an electric haircutter as claimed in claim 5, wherein the lever switch has a bump, and a second fixed portion disposed at the rear end of the adjusting lever, and a connection is defined by clamping and fixing the second fixed portion to the bump.

7. The staggered multilayer trimming head applied in an electric haircutter as claimed in claim 3, wherein the second moving knife has a hook formed at a rear end of the second moving knife, and a first fixed portion disposed at a front end of the adjusting lever and configured to be corresponsive to the hook, and a connection is defined by clamping the first fixed portion to the hook.

8. The staggered multilayer trimming head applied in an electric haircutter as claimed in claim 7, further comprising a lever switch coupled to the rear end of the adjusting lever and disposed in one of the at least one window to facilitate adjusting the position of the second moving knife.

9. The staggered multilayer trimming head applied in an electric haircutter as claimed in claim 8, wherein the lever switch has a bump, and a second fixed portion disposed at the rear end of the adjusting lever, and a connection is defined by clamping and fixing the second fixed portion to the bump.

* * * * *